US010443184B2

(12) United States Patent
Park et al.

(10) Patent No.: US 10,443,184 B2
(45) Date of Patent: Oct. 15, 2019

(54) CONTROL METHOD FOR LAUNDRY TREATING APPARATUS

(71) Applicant: LG ELECTRONICS INC., Seoul (KR)

(72) Inventors: Simong Park, Seoul (KR); Ingeon Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 113 days.

(21) Appl. No.: 15/786,813

(22) Filed: Oct. 18, 2017

(65) Prior Publication Data

US 2018/0112350 A1 Apr. 26, 2018

(30) Foreign Application Priority Data

Oct. 25, 2016 (KR) ..... 10-2016-0139298

(51) Int. Cl.
*D06F 58/28* (2006.01)
*D06F 58/10* (2006.01)

(52) U.S. Cl.
CPC ..... *D06F 58/28* (2013.01); *D06F 58/10* (2013.01); *D06F 2058/2816* (2013.01); *D06F 2058/2819* (2013.01); *D06F 2058/2864* (2013.01); *D06F 2058/2896* (2013.01)

(58) Field of Classification Search
CPC .. D06F 58/28; D06F 58/10; D06F 2058/2816; D06F 2058/2819; D06F 2058/2864
USPC ..... 34/523
See application file for complete search history.

(56) References Cited

U.S. PATENT DOCUMENTS 5,682,684 A * 11/1997 Wentzlaff ..... D06F 58/28 34/495
6,931,759 B2 * 8/2005 Jeong ..... D06F 58/28 324/664
6,931,760 B2 * 8/2005 Yang ..... D06F 58/28 307/650
7,594,343 B2 * 9/2009 Woerdehoff ..... D06F 58/28 219/497
7,921,578 B2 * 4/2011 McAllister ..... D06F 35/00 134/10
9,133,575 B2 * 9/2015 Hong ..... D06F 25/00
9,249,539 B2 * 2/2016 Hubig ..... A47L 15/0034
10,087,572 B2 * 10/2018 Bilionis ..... D06F 58/28
(Continued)

FOREIGN PATENT DOCUMENTS

BR PI0715915 A2 * 8/2013 ..... A47L 15/0034
CA 2 576 032 8/2007
(Continued)

*Primary Examiner* — Stephen M Gravini
(74) *Attorney, Agent, or Firm* — KED & Associates, LLP

(57) ABSTRACT

A laundry treating apparatus comprises a drum receiving clothes; a fan supplying air to the drum; a heater heating the air supplied to the drum; and a dry level sensing unit determining a dry level of the clothes. A control method comprises setting a dry time; supplying air to the clothes by operating the fan or operating the fan and the heater, and controlled to be performed for the dry time; and resetting the dry time, when the dry level measured by the dry level sensing unit at a time past a preset reference time period from the start of the air supply step is less than a preset reference dry level, wherein resetting the dry time step adds more time to the reference time period.

19 Claims, 2 Drawing Sheets

(56) References Cited

U.S. PATENT DOCUMENTS

| | | | | |
|---|---|---|---|---|
| 2002/0000049 | A1* | 1/2002 | Woerdehoff | D06F 58/28 34/313 |
| 2005/0091875 | A1* | 5/2005 | Kim | D06F 58/28 34/486 |
| 2005/0188471 | A1* | 9/2005 | Ahn | D06F 25/00 8/158 |
| 2007/0163056 | A1* | 7/2007 | Lee | D06F 25/00 8/149.2 |
| 2007/0186438 | A1* | 8/2007 | Woerdehoff | D06F 58/28 34/486 |
| 2008/0072448 | A1* | 3/2008 | Hubig | A47L 15/0034 34/446 |
| 2018/0112350 | A1* | 4/2018 | Park | D06F 58/10 |
| 2018/0298548 | A1* | 10/2018 | Kim | D06F 58/28 |

FOREIGN PATENT DOCUMENTS

| | | | | | |
|---|---|---|---|---|---|
| EP | 1818441 | A1 * | 8/2007 | | D06F 58/28 |
| EP | 1577433 | B2 * | 11/2015 | | D06F 25/00 |
| EP | 3315653 | A1 * | 5/2018 | | D06F 58/10 |
| JP | 5539722 | B2 * | 7/2014 | | A47L 15/0034 |
| WO | WO-2008038228 | A3 * | 6/2008 | | A47L 15/0034 |

* cited by examiner

CONTROL METHOD FOR LAUNDRY TREATING APPARATUS

CROSS-REFERENCE TO RELATED APPLICATION(S)

This application claims priority under 35 U.S.C. § 119 to Korean Application No. 10-2016-0139298, filed on Oct. 25, 2016, whose entire disclosure is hereby incorporated by reference.

BACKGROUND

1. Field

Embodiments of the present disclosure relate to a control method for a laundry treating apparatus having a dry function.

2. Background

Laundry treating apparatuses with a dry (or drying) function are electric appliances configured to remove moisture from clothes by supplying heated-air to the clothes. A laundry treating apparatus with the dry function may be categorized into an electric appliance for drying clothes and an electric appliance for washing as well as drying clothes.

The laundry treating apparatus for drying clothes may include a drum in which clothes are held; and an air supply unit for supplying heated-air to the drum. The laundry treating apparatus for washing as well as drying clothes includes a tub for defining a predetermined space in which water is stored; a drum rotatably mounted in the tub and holding clothes therein; and an air supply nit for supplying heated-air to the tub.

It is a very important design factor in the conventional laundry treating apparatuses having the structure mentioned above how to control a dry time. In other words, the total power consumption of the laundry treating apparatus is determined based on how to control an operation time of the air supply unit and whether the clothes are dried to a desired level (in other words, whether a reference dry level is reached). Accordingly, it is very important to control the operation of the air supply unit.

A dry time is determined in the conventional laundry treating apparatuses based on a dry course which is selected by a user. If a large amount of clothes are loaded, the dry level of the clothes might fail to reach a reference dry level (in other words, a dry performance might be low) disadvantageously.

Moreover, in case of a small amount of clothes, the conventional laundry treating apparatus is likely to have a disadvantage of energy waste which might be caused by the operation of the air supply unit during the dry time set in an early stage even after the dry level of the clothes reaches the reference dry level.

BRIEF DESCRIPTION OF THE DRAWINGS

The embodiments will be described in detail with reference to the following drawings in which like reference numerals refer to like elements and wherein.

DETAILED DESCRIPTION

Figure 1:
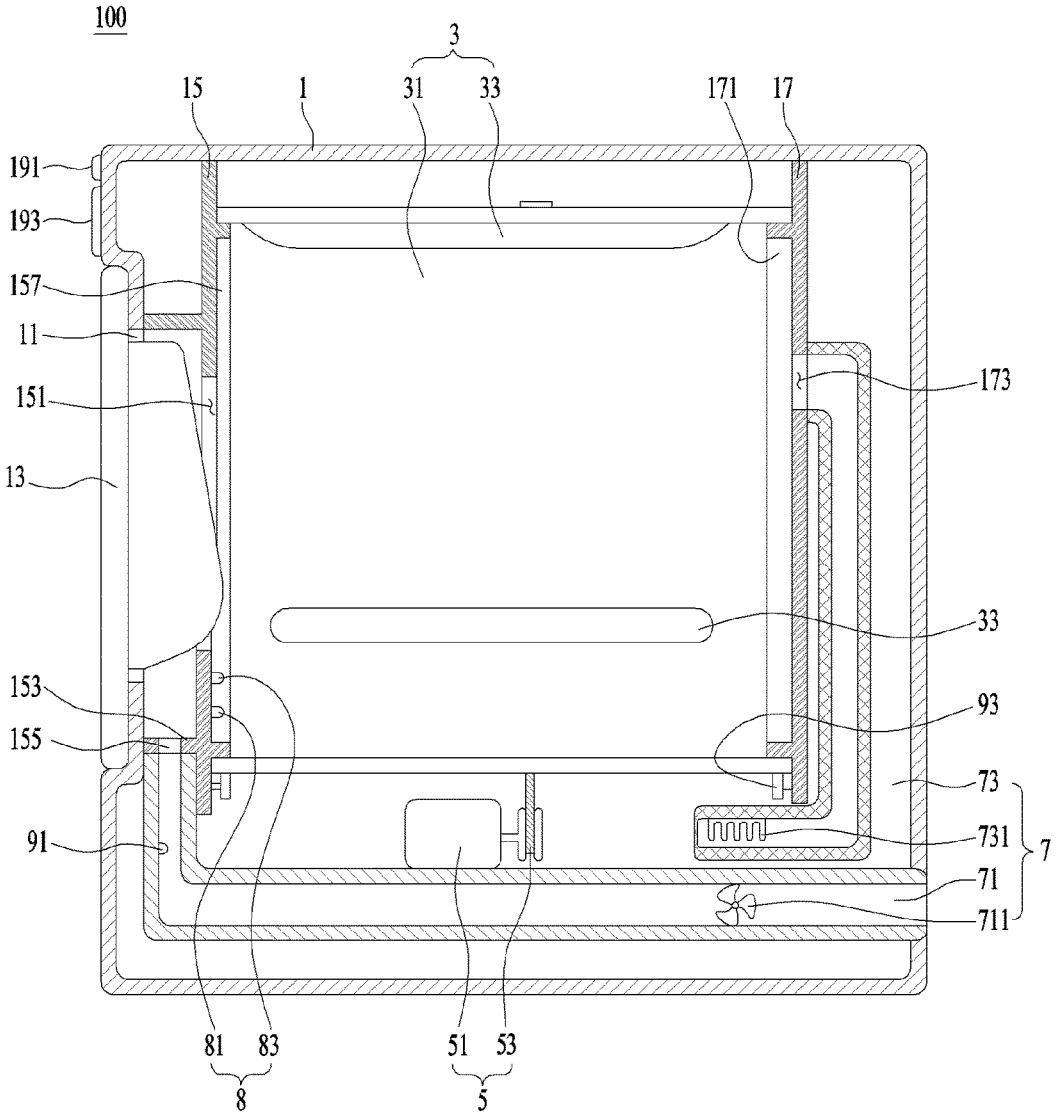
FIG. 1 is a diagram illustrating one embodiment of a laundry treating apparatus in accordance with the present disclosure.

Preferred embodiments of the present disclosure will be described below in more detail with reference to the accompanying drawings. Elements and control methods of the present disclosure which are described as follows may, however, be embodied in different forms and should not be constructed as limited to the embodiments set forth herein. Description of a laundry treating apparatus with a drying function will now be given in detail according to exemplary embodiments disclosed herein, with reference to the accompanying drawings. For the sake of brief description with reference to the drawings, the same or equivalent components may be provided with the same reference numbers, and description thereof will not be repeated.

A laundry treating apparatus 100 in accordance with exemplary embodiments of the present disclosure may include a cabinet 1; a drum 3 provided in the cabinet and defining a predetermined space in which clothes are held; a drive unit 5 for rotating the drum; and a supply unit 7 for supplying not-heated air or heated-air to the drum. The cabinet 1 includes a cabinet opening 11 for loading or unloading clothes into the drum 3 or out of the cabinet. The cabinet opening 11 is open or closed by a door 13.

The drum 3 may include a cylindrical drum body 31 with open front and rear surface; and a lifter (33 as agitating means for clothes) projected from a circumferential surface of the drum body toward a center of the drum body. To rotatably support the drum, the cabinet 1 may include a front support unit 15 supporting a front surface of the drum; and a rear support unit 17 for supporting the rear surface of the drum.

In other words, a first supporter 157 is provided in the front support unit 15 and inserted in the front surface of the drum body 31. A second support 171 is provided in the rear support unit 17 and inserted in the rear surface of the drum body 31 to rotatably support the drum body.

Meanwhile, an introduction hole 151 is provided in the front support unit 15 to facilitate communication between the cabinet opening 11 and an internal space of the drum body 31. The inlet hole 151 may be located in the space defined by the first support unit 157.

The front support unit 15 is connected with a front surface of the cabinet 1 via a connection unit 153. The connection unit 153 may be formed in a circular cylinder shape. In this instance, an outlet hole 155 is provided in the connection unit 153 to exhaust the air drawn from the drum body 31 via the introduction hole 151 outside the connection unit 153.

The drive unit 5 may be provided in any shapes only if capable of rotating the drum. As one example, FIG. 1 shows that the drive unit 5 includes a motor 51 fixed in the cabinet and a belt 53 for connecting a rotary shaft of the motor with a circumferential surface of the drum body 31.

The supply unit 7 may include a first duct 71 connected with the outlet hole 155 and configured to guide the air exhausted from the drum body 31 outside the cabinet 1; and a second duct 73 configured to guide air into the drum body 31; a fan 711 provided in the first duct; and a heater 731 provided in the second duct. In this instance, an inlet hole 173 may be further provided in the rear support unit 17 and connected with the second duct 73.

The fan 711, the heater 731 and the drive unit 5 may be controlled by a controller (not shown). The user is able to input a control command to the controller via an input unit 191 provided in the cabinet 1. The user is able to check types of selectable control commands or the operation process of the laundry treating apparatus 100, while seeing a display unit 193 provided in the cabinet.

Meanwhile, the supply unit 7 mentioned above is provided to realize an exhaustion type dry system. If the laundry treating apparatus of the present disclosure has to be provided as a circulation type dry system, a free end of the first duct 71 and a free end of the second duct 73 are connected with each other. The heater 731 has to be replaced by a heat pump which is capable of dehumidifying and heating air.

The embodiment mentioned above is applicable in case the laundry treating apparatus 100 of the present disclosure is provided as the device for drying clothes. However, the laundry treating apparatus 100 may be provided as the device for washing as well as drying the clothes. In case the laundry treating apparatus 100 is provided as the device for washing as well as drying the clothes, the front support unit 15 and the rear support unit 17, which are described above, may be omitted and the tub for defining the space in which water is held has to be provided in the cabinet.

The tub may be provided in any shapes only if capable of defining the space in which water is held. Examples of the shapes may include a cylindrical tub. In this instance, the drum 3 has to be rotatable cylinder shape in the tub and the first and second ducts 71 and 73 have to be in communication with the tub inside. A tub opening has to be provided in a front surface of the tub and in communication with the cabinet opening 11. A drum opening has to be provided in a front surface of the drum and in communication with the tub opening.

Meanwhile, the laundry treating apparatus 100 may further include a dry level sensing unit (also referred to herein as a dryness level sensor) 8 for measuring a dry (or dryness) level of the clothes loaded in the drum body 31. The dry level sensing unit 8 may be provided in any shapes or configuration capable of measuring the amount or percentage of the water content contained in the clothes (a rate of water to mass of clothes). As one example, FIG. 1 shows that the dry level sensing unit 8 includes a first terminal 81 fixed to the front support unit 15; and a second terminal 83 fixed to the front support unit 15 and spaced a preset distance from the first terminal.

The dry level sensing unit 8 may be configured to generate a voltage signal with an amplitude or voltage which is proportional to the amount of the water contained in the clothes, when the clothes held in the drum body 31 allow the first and second terminals 81 and 82 to be connected with each other. In other words, the first terminal is connected to a positive pole and the second terminal 83 is connected to a negative pole of the power.

When the wet clothes keep contact with the two terminals 81 and 83, electricity flows to the two terminals 81 and 83. Accordingly, the controller is implemented to recognize presence of the electric currents flowing to the clothes and the two terminals so as to determine whether clothes are loaded in the drum body 31.

Meanwhile, when the dry level of the clothes rises high, the amount of the moisture contained in the clothes is reduced. That means that resistance increases in the clothes employed as a circuit for connecting the two terminals with each other. Accordingly, when the controller is configured to measure the size of the current (or the size of the voltage) which flows in the clothes and the two terminals 81 and 83, the laundry treating apparatus may determine the dry level of the clothes.

Moreover, the laundry treating apparatus 100 in accordance with the present disclosure may further include a temperature sensing unit (also referred to herein as a temperature sensor) 91 for measuring the temperature of the clothes. The temperature sensing unit 91 may be provided as a temperature sensor for directly measuring the temperature of the clothes or a temperature sensor for indirectly measuring the temperature of the clothes by measuring the temperature of the air exhausted from the drum body 31. As one example, FIG. 1 shows that the temperature sensing unit 91 is provided in the first duct 71 and configured to measure the temperature of the air exhausted from the drum body 31.

Once the clothes are dried to a desired level (once the dry level of the clothes reaches the reference dry level), it is preferred to lower the temperature of the clothes. If the temperature of the clothes is high, the user's hand might hurt and the temperature sensing unit 91 mentioned above is then provided as the means for preventing such risks.

Meanwhile, the laundry treating apparatus 100 may further include a laundry amount sensing unit (also referenced to herein as a laundry mass sensor) 93 for measuring the amount of the clothes held in the drum body 31. The laundry amount sensing unit 93 may be provided as a device configured to measure the load of the drum body 31 or a device configured to measure the amount of the currents supplied to the motor 51 to rotate the drum body 31 as much as a preset angle.

Figure 2:
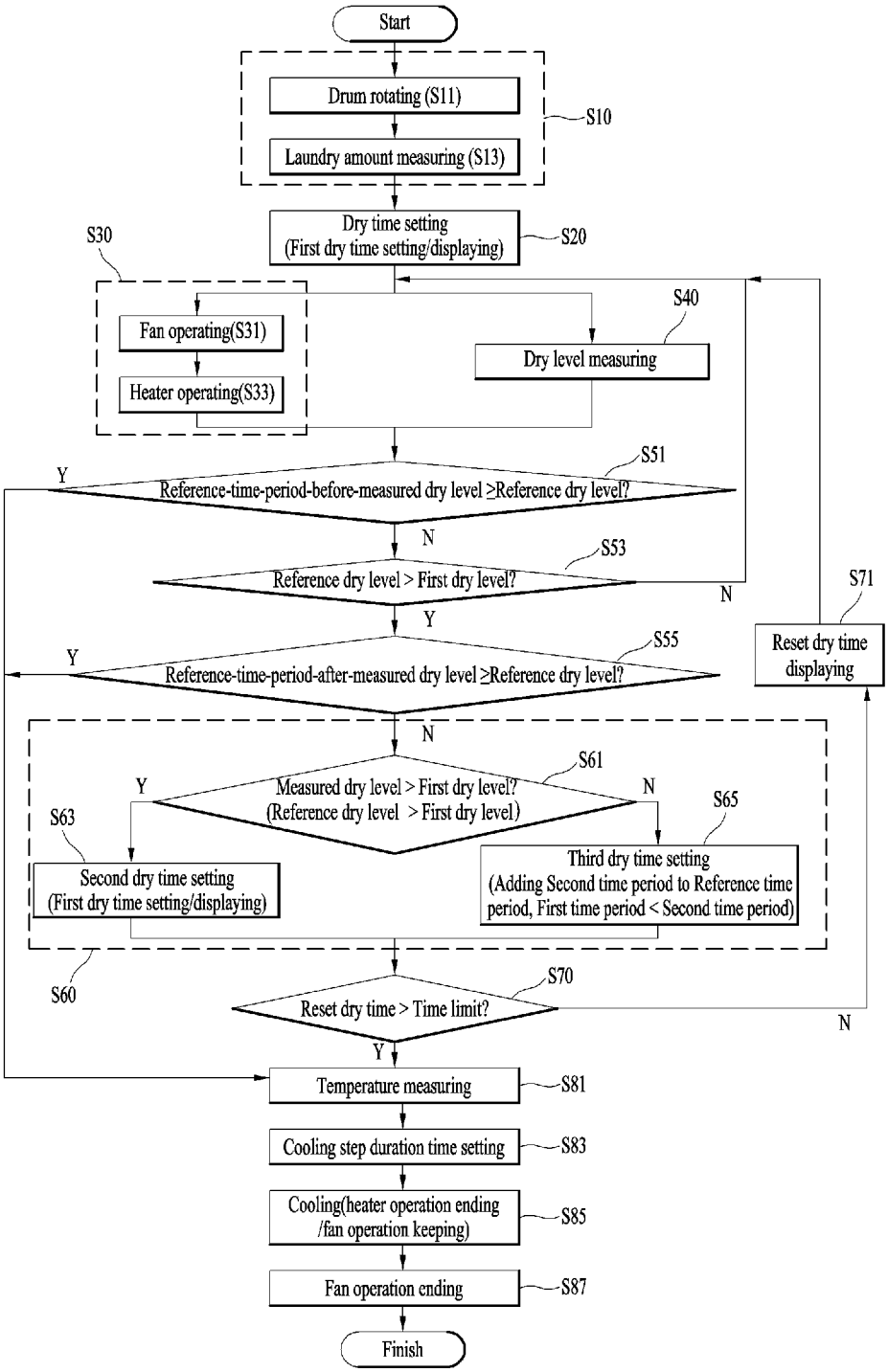
FIG. 2 is a diagram illustrating one embodiment of a control method for a laundry treating apparatus.

FIG. 2 is a diagram illustrating one embodiment of a control method for a laundry treating apparatus. The control method in accordance with the embodiment includes a dry time setting step (S20); an air supply step (S30) for supplying air to the clothes for a preset dry time; and a dry time re-setting step (S60) for resetting the dry time set in the dry time setting step (S20) when the dry level measured by the dry level sensing unit 8 in a preset time period after a reference time from the start of the air supply step (S30) is less than a reference dry level (also referred to as a reference dryness level or a first reference dryness level).

In the dry time setting step (S20), the time period for which heated-air or not-heated-air is supplied to the drum body 31 is set. The dry time setting step (S20) may be implemented by the controller's selecting a corresponding one of the preset dry times to the control command for the fan 711 and the heater 731 input by the user via the input unit 191 or the user's direct selecting of free time periods via the input unit 191. Or, the user may select one of the dry times displayed on the display unit 193 via the input unit 193.

Meanwhile, when the laundry amount sensing unit 93 is provided in the laundry treating apparatus 100, the control method may further include a laundry amount sensing step (S10) for measuring the amount of the clothes loaded in the drum body 31. In the dry time setting step (S20), the controller may set the increased time period in proportion to the amount of the clothes sensed by the laundry amount sensing unit 93 as the dry time.

The laundry amount sensing step (S10) may include a drum rotating step (S11) for rotating the drum body 31 by controlling the drive unit 5; and a laundry amount measuring step (S13) for measuring the amount of the clothes by controlling the laundry sensing unit 93, while the drum body is being rotated.

The air supply step (S30) may be a step for supplying the not-heated-air to the clothes by operating only the fan 711 or supplying the heated-air to the clothes by operating both the fan 711 and the heater 731. In the latter case, the air supply step (S30) may sequentially implement a fan operating step (S310) and a heater operating step (S33), to prevent the heater's overheat if the heater is operated first.

During the air supply step (S30), the control method may implement a dry level measuring step (S40) for measuring a dry level of the clothes loaded in the drum body 31. The dry level measuring step (S40) is performed by using the dry sensing unit 8. Also, the dry level measuring step (S40) may be periodically implemented at preset intervals during the air supply step (S30).

In contrast to what is mentioned above, the dry level measuring step (S40) may be implemented to continuously measure dry levels (measure serial dry levels) until the air supply step (S30) finishes from the start and transmit the measured dry levels to the controller. Meanwhile, once the dry level of the clothes is measured in the dry level measuring step (S40), the control method implements a determining step (S53) for determining whether the air supply step (S30) is implemented past a reference time period from the start.

The reference time period may be set as the time period which remains from the end of the preset dry time set in the dry time setting step (S20). In case the dry time is reset in the dry time resetting step (S60), the reference time period has to be set as the time period which remains from the end of the newly reset dry time.

It is preferred that the remaining set time period (the reference time period) is 10 minutes or more. For example, the reference time period is set as 11 minutes and the dry time is set as 100 minutes in the dry time setting step. In this instance, the reference time period is the time point of 89 minutes once the air supply step starts.

Once the reference time passes from the start of the air supply step (S30), the control method of the present disclosure starts a determining step (S55) for determining whether the dry level measured after the reference time period passes reaches the reference dry level. The reference dry level is used as the factor determining whether to end the air supply step (S30) and it may be set to be the current or voltage output by the dry level sensing unit 8 when the moisture content is 3% or less (or the dry level is 97% or more).

When the dry level measured after the reference time period is the reference dry level or more based on the result of the determination (S55), the control method starts a cooling step (S85). The cooling step (S85) is the step for pausing the operation of the heater 731 and keeping the operation of the fan 711. The cooling step may be performed for the same or less time period with or than the setting time period.

In the latter case, the duration time of the cooling step (S85) may be set to be different according to the temperature of the clothes. For that, the control method in accordance with the present disclosure may further include a temperature measuring step (S81) for measuring the temperature of the clothes loaded in the drum; and a setting step (S83) for setting the time period increasing in proportion to the measured temperature of the temperature measuring step as the duration time of the cooling step. When the cooling step (S85 is performed for the set duration time of the cooling step, the control method ends the operation of the fan to end the operation of the laundry treating apparatus.

Meanwhile, when the dry level measured after the reference time period is the reference dry level or less based on the result of the determination (S55), the control method starts the dry time resetting step (S60). In the dry time resetting step (S60), the more time is added to the reference time period and reset as the measured dry level after the reference time period is lower.

The dry time resetting step (S60) may include a determining step (S61) for determining whether the dry level measured after the reference time period is a first dry level (or second reference dryness level) or more (set as a smaller value than the reference dry level or first reference dryness level). When the dry level measured after the reference time period is higher than the first dry level and lower than the reference level, the dry time resetting step starts a step (S63) for setting the time period calculated after a first time period is added to the reference time period as a new dry time (a second dry time).

However, when the measured dry level is lower than the first dry level, the dry time resetting step starts a step (S65) for setting the time period calculated after a second time period set longer than the first time period is added to the reference time period as a new dry time (a third dry time). The first time period has to be set as the time which makes the new dry time, which is set after the first time period is added to the reference time period, longer than the former dry time period set shortly before.

Accordingly, control method of the laundry treating apparatus may positively adjust the dry time based on the dry level and then facilitate the high dry performance.

When the dry time is reset in the dry time resetting step (S60), the control methods notifies the reset dry time to the user by controlling the display unit 193 (S71). Unless recognizing the increased dry time, the user is likely to suspect failure of the laundry treating apparatus.

Moreover, when the dry time is reset in the dry time resetting step (S60), the air supply step (S30) is performed for the reset dry time (until the reset dry time passes from the start of the air supply step). When the air supply step (S30) is being performed until the duration time reaches the reference time period (the time point when the setting time remains from the start of the reset dry time), the steps (S40, S53, S55 and S60) shown in FIG. 2 are repeatedly performed.

In this instance, when the dry time rest in the second dry time setting step (S63 or the third dry time setting step (S65) is a preset time limit or more (S70), the control method in accordance with the present disclosure performs the temperature measuring step (S81), the cooling step duration time setting step (S83), the cooling step (S85) and the fan operation ending step (S7) sequentially and then ends the operation of the laundry treating apparatus. To prevent the unlimited increase of the operation time, the time limit may be set as 5 to 6 hours. Accordingly, the control method may keep the dry performance of the laundry treating apparatus and conserve energy.

Meanwhile, the control method may further include a determining step (S51) for determining whether the dry level measured before the dry time reaches the reference time period is the reference time period or more. The clothes might be dried to a desired dry level before the reference time period. In this instance, if the air supply step (S30) is performed until the set dry time, the energy waste might occur.

When the dry level measured before the dry time reaches the reference time period is the reference dry level or less, the control method starts the determining step (S53) for determining whether the dry time reaches the reference time period. However, when the dry level is the reference level or more before reaching the reference time period, the control method may perform the cooling step (S85 and the fan operation ending step (S87) sequentially and then end the operation of the laundry treating apparatus. Before performing the cooling step, the control method may perform the temperature measuring step (S81) and the cooling step duration time setting step (S83).

In the embodiments mentioned above, the dry time resetting step (S60) is described based on the case that the dry time is reset based on one dry level (the first dry level). However, the dry time resetting step (S60) may be configured to reset the dry time based on two or more dry levels.

More specifically, when the measured dry level is lower than the reference dry level and higher than the preset first dry level, the dry time resetting step (S60) may set the time period calculated after the first time period is added to the reference time period as a new dry time. However, when the measured dry level is lower than the first dry level and higher than the second dry level (or third reference dryness level) set lower than the first dry level, the time calculated after the second time period longer than the first time period is added to the reference time period may be set as a new dry time. When the measured dry level is lower than the second dry level, the dry time resetting step may reset the time period calculated after the third time period set longer than the second time period is added to the reference time period as a new dry time.

Embodiments of the present disclosure provide a control method for a laundry treating apparatus which may economize in energy with a high dry performance by adjusting a dry time actively. Embodiments of the present disclosure also provide a control method for a laundry treating apparatus comprising a drum rotatably provided and defining a space in which clothes are stored; a fan supplying air to the drum; a heater heating the air supplied to the drum; a dry level sensing unit determining a dry level of the clothes; and a controller controlling the heater and receiving the data transmitted by the dry level sensing unit, the control method comprising: a dry time setting step for setting a dry time; an air supply step for supplying air to the clothes by operating the fan or operating the fan and the heater and controlled to be performed for the dry time; and a dry time resetting step for resetting the dry time, when the dry level measured by the dry level sensing unit at a time past a preset reference time period from the start of the air supply step is less than a preset reference dry level, wherein the dry time resetting step resets the dry time period by adding more time to the reference time period as the dry level measured at the reference time period elapsed is lower.

The dry time resetting step may resets the dry time period calculated after a first time period is added to the reference time period as a new dry time period when the measured dry level is lower than the preset reference dry level and higher than a preset first dry level which is lower than the preset reference dry level, and the dry time resetting step may resets the time period calculated after a second time period longer than the first time period is added to the reference time period as a new dry time period when the measured dry level is lower than the first dry level.

The control method for the laundry treating apparatus of claim 1, wherein the dry time resetting step may resets the time period calculated after a first time period is added to the reference time period as a new dry time period when the measured dry level is lower than the preset reference dry level and higher than a preset first dry level, and the dry time resetting step may resets the time period calculated after a preset second time period longer than the first time period is added to the reference time period as a new dry time period when the measured dry level is lower than the first dry level and higher than a second dry level lower than the first dry level, and the dry time resetting step may resets the time period calculated after a third time period longer than the second time period is added to the reference time period as a new dry time period when the measured dry level is lower than the second dry level.

The air supply step may be performed until the reset dry time period passes when the dry time is reset in the dry time resetting step. The control method for the laundry treating apparatus may further comprise a noticing step for noticing the reset dry time period to a user when the dry time period is reset in the dry time resetting step. The control method for the laundry treating apparatus may further comprise a dry level measuring step for periodically or continuously measuring the dry level of the clothes stored in the drum by controlling the dry level sensing unit.

The reference time period may be set as a time point at which a setting time remains from the end of the dry time set in the dry time setting step, and, the reference time period may be set as a time point at which the setting time remains from the end of the new dry time reset in the dry time resetting step when a new dry time is set in the dry time resetting step. The setting time may be set as 10 minutes or more.

The control method for the laundry treating apparatus may further comprise a cooling step for pausing the operation of the heater and keeping the operation of the fan when the dry level measured before the reference time period passes is the preset reference dry level or more.

The control method for the laundry treating apparatus may further comprise a cooling step for pausing the operation of the heater and keeping the operation of the fan when the dry level measured after the reference time period passes is the preset reference dry level or more. The cooling step may be performed for the same time period with the setting time period or a shorter time period than the setting time period.

The control method for the laundry treating apparatus may further comprise a temperature measuring step for measuring the temperature inside the drum the temperature of the clothes stored in the drum by controlling the temperature sensing unit, wherein the duration time of the cooling step is set to increase in proportion to the temperature measured in the temperature measuring step. The dry time setting step may set as the dry time one of the time periods preset by the controller when control commands (course selecting) of the fan and the heater are inputted to the input unit transmitting a control command to the controller. The dry time setting step may set the dry time period input by the user or selected by the user in plurality of preset time periods through the input unit transmitting a control command to the controller.

The control method for the laundry treating apparatus may further comprise a laundry amount determining step for determining the amount of the clothes stored in the drum through a laundry amount sensing unit measuring the load of the drum or the amount of the currents supplied to a drive unit rotating the drum as much as a preset angle, wherein the dry time setting step sets the dry time period by the controller in proportion to the amount of the clothes measured in the laundry amount determining step. According to the embodiments of the present disclosure, the control method of the laundry treating apparatus may economize in energy with a high dry performance by adjusting a dry time actively.

Various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method to control a laundry treating apparatus, the method comprising:

setting a drying time period;

supplying air to laundry in the laundry treating apparatus, wherein supplying the air includes operating a fan during the drying time period;

resetting the drying time period when a dryness level of the laundry, measured after a reference time from a start of the supplying of the air, is less than a first reference dryness level, wherein resetting the drying time period includes adding more time period to the reference time as the dryness level measured at the reference time is lower; and deactivating a heater that warms the air supplied by the fan and continuing to operate the fan when a dryness level measured during the reference time is equal to or greater than the first reference dryness level, wherein the reference time expires at a time point at which a prescribed amount of time remains before the drying time period ends.

2. The method of claim 1, wherein resetting the drying time period includes:

adding a first time to the reference time when the measured dryness level is lower than the first reference dryness level and higher than a second reference dryness level which is lower than the first reference dryness level, and adding a second time, which is longer than the first time, to the reference time when the measured dryness level is lower than the second reference dryness level.

3. The method of claim 1, wherein resetting the drying time period includes:

adding a first time to the reference time when the measured dryness level is lower than the first reference dryness level and higher than a second reference dryness level which is lower than the first reference dryness level;

adding a second time, which is longer than the first time, to the reference time period when the measured dryness level is lower than the first and second reference dryness levels and higher than a third reference dryness level that is lower than the second reference dryness level; and adding a third time, which is longer than the second time, to the reference time when the measured dryness level is lower than the third reference dryness level.

4. The method of claim 1, wherein the supplying of the air continues until the reset drying time period passes.

5. The method of claim 1, further comprising:

providing a notification of the reset drying time period to a user.

6. The method of claim 1, further comprising:

periodically or continuously measuring the dryness level of the laundry in the drum.

7. The method of claim 1, wherein the prescribed amount of time is ten minutes or more.

8. The method of claim 1, further comprising:

deactivating a heater that warms the air supplied by the fan and continuing to operate the fan when a dryness level measured after the reference time is equal to or greater than the first reference dryness level.

9. The method of claim 8, wherein the fan continues to be operated while the heater is deactivated during a duration time that is equal to or less than the prescribed amount of time in the drying time period after the reference time.

10. The method of claim 9, further comprising:

measuring a temperature inside the drum or of the laundry, wherein the duration time increases in proportion to the measured temperature.

11. The method of claim 1, wherein the drying time period is initially set to a respective time period associated with a selected drying mode.

12. The method of claim 1, wherein the drying time period is initially set to a time period corresponding to a user input.

13. The method of claim 1, further comprising:

determining an amount of the laundry, wherein the reset drying time period added to the reference time when resetting the drying time period increases in proportion to the determined amount of the laundry.

14. A laundry apparatus comprising:

a drum to receive laundry;

a fan to supply air to the laundry during a drying time period;

a dryness level sensor to measure a dryness level of the laundry;

a controller to reset the drying time when the measured dryness level of the laundry, after a reference time from a start of the drying time period, is less than a reference dryness level, wherein the controller, when resetting the drying time, adds more time period to the reference time as the dryness level measured at the reference time is lower.

15. The laundry apparatus of claim 14, further comprising:

a user interface to provide a notification of the reset drying time period to a user.

16. The laundry apparatus of claim 14, wherein the dryness level sensor is coupled to the drum to provide a current through the laundry, and determines the dryness level based on a measured resistance through the laundry.

17. The laundry apparatus of claim 14, further comprising:

a temperature sensor to measure a temperature inside the drum or of the laundry, wherein the controller further deactivates a heater that warms the air supplied by the fan and continues to operate the fan during a duration time when the dryness level is equal to or greater than the reference dryness level, and wherein the duration time increases in proportion to the measured temperature.

18. The laundry apparatus of claim 14, further comprising:

a laundry mass sensor to measure a mass of the laundry based on a load of the drum or an amount of current supplied to a motor rotating the drum by at least a preset angle, wherein the controller further determines the reset drying time period added when resetting the drying time period in proportion to the mass of the laundry.

19. The laundry apparatus of claim 1, wherein the reset drying time period is lower than a preset time limit to prevent an unlimited increase of an operation time of the laundry treating apparatus.

* * * * *